US009449505B2

(12) United States Patent
Masutani

(10) Patent No.: US 9,449,505 B2
(45) Date of Patent: Sep. 20, 2016

(54) TRAFFIC CONGESTION PREDICTION METHOD AND TRAFFIC CONGESTION PREDICTION DEVICE

(71) Applicant: DENSO IT LABORATORY, INC., Tokyo (JP)

(72) Inventor: Osamu Masutani, Tokyo (JP)

(73) Assignees: DENSO IT LABORATORY, INC., Tokyo (JP); DENSO CORPORATION, Aichi (JP)

( * ) Notice: Subject to any disclaimer, the term of this patent is extended or adjusted under 35 U.S.C. 154(b) by 337 days.

(21) Appl. No.: 13/795,610

(22) Filed: Mar. 12, 2013

(65) Prior Publication Data

US 2013/0253812 A1 Sep. 26, 2013

(30) Foreign Application Priority Data

Mar. 26, 2012 (JP) ..... 2012-069977

(51) Int. Cl.
*G08G 1/00* (2006.01)
*G08G 1/01* (2006.01)

(52) U.S. Cl.
CPC ..... *G08G 1/00* (2013.01); *G08G 1/0112* (2013.01); *G08G 1/0133* (2013.01); *G08G 1/0141* (2013.01); *G08G 1/0145* (2013.01)

(58) Field of Classification Search
None
See application file for complete search history.

(56) References Cited

U.S. PATENT DOCUMENTS 7,747,381 B2 * 6/2010 Adachi ..... G01C 21/3691 340/995.13
7,912,628 B2 * 3/2011 Chapman ..... G01C 21/3691 701/117
8,090,524 B2 * 1/2012 Chapman ..... G01C 21/3691 701/117
8,483,940 B2 * 7/2013 Chapman ..... G01C 21/3691 701/117

(Continued)

FOREIGN PATENT DOCUMENTS

CN 1661645 A 8/2005
JP 1994-305438 A * 11/1994

(Continued)

OTHER PUBLICATIONS

Machine Translation of JP 2009-289223A.*

(Continued)

*Primary Examiner* — John R Olszewski
*Assistant Examiner* — Jean-Paul Cass
(74) *Attorney, Agent, or Firm* — Louis Woo

(57) ABSTRACT

Provided is a traffic congestion prediction method which is able to perform a prediction process using floating information with higher accuracy. The traffic congestion prediction method includes: a step of receiving information by a prediction device; a step of predicting a route of each floating car based on the current position information and destination information received; a step of calculating, for the each floating car, a first passing time group which is a set of respective passing times at a plurality of predetermined spots on the route predicted; a step of calculating the number of existing floating cars per link based on the first passing time group, if any of a plurality of floating cars exists on the link at a predetermined time; and a step of calculating a second passing time group by use of the number of existing floating cars and a predetermined calculation technique.

3 Claims, 5 Drawing Sheets

(56) References Cited

U.S. PATENT DOCUMENTS

| | | | | |
|---|---|---|---|---|
| 8,682,571 | B2 * | 3/2014 | Chapman | G01C 21/3691 701/117 |
| 2005/0171649 | A1 * | 8/2005 | Adachi | G01C 21/3691 701/1 |
| 2005/0206534 | A1 | 9/2005 | Yamane et al. | |
| 2007/0106465 | A1 * | 5/2007 | Adam | G01C 21/3492 701/533 |
| 2008/0071465 | A1 * | 3/2008 | Chapman | G01C 21/3691 701/117 |
| 2008/0215233 | A1 * | 9/2008 | Adachi | G01C 21/3691 701/118 |
| 2011/0117896 | A1 * | 5/2011 | Soelberg | G08G 1/0104 455/414.3 |
| 2011/0173015 | A1 * | 7/2011 | Chapman | G01C 21/3691 705/1.1 |
| 2012/0130625 | A1 * | 5/2012 | Srivastava | G01C 21/3492 701/119 |
| 2012/0150425 | A1 * | 6/2012 | Chapman | G01C 21/3691 701/119 |
| 2013/0151135 | A1 * | 6/2013 | Aubrey | G08G 1/00 701/118 |
| 2013/0211706 | A1 * | 8/2013 | MacNaughtan | G08G 1/0112 701/410 |
| 2013/0289862 | A1 * | 10/2013 | Chapman | G01C 21/3691 701/118 |

FOREIGN PATENT DOCUMENTS

| | | |
|---|---|---|
| JP | 2008-112221 | 5/2008 |
| JP | 2009-289223 | 12/2009 |
| JP | 2010-033331 | 2/2010 |
| JP | 2010-33331 | 2/2010 |

OTHER PUBLICATIONS

Machine Translation of JP 2010-33331A.*

Japanese Office Action issued on Mar. 18, 2014 in corresponding priority Japanese application No. 2012-069977.

Chinese Office Action issued on Dec. 31, 2014 in co-pending Chinese application No. 20130082945.8.

* cited by examiner

QV CURVE

TRAFFIC CONGESTION PREDICTION METHOD AND TRAFFIC CONGESTION PREDICTION DEVICE

TECHNICAL FIELD

The present invention relates to a traffic congestion prediction method and a traffic congestion prediction device for performing traffic congestion prediction and the like based on information from floating cars.

BACKGROUND ART

Traffic congestion prediction in a conventional floating car system has been performed in such a manner that only pieces of information on current positions of floating cars are collected, and based on these pieces of information on the current positions, present traffic congestion information is generated and traffic congestions are predicted. As an example using such floating cars, there is a technique disclosed in Patent Document 1 as below.

[Patent Document 1] Japanese Patent Application Publication No. 2003-151085 (Abstract)

SUMMARY OF THE INVENTION

Since the traffic congestion prediction in the conventional floating car system performs traffic congestion prediction or the like based on information on current positions of floating cars, that a new floating car appears right down a route where a floating car heads for or that an existing floating car goes out from the route is not reflected on the traffic congestion prediction. Therefore, there may be such a case that, when the floating car goes ahead through the route, the traffic may be heavier or lighter than the traffic congestion prediction, and thus, it has been difficult to perform prediction with high accuracy. Further, a process in the conventional floating car system has such a problem that it takes too much processing time. Further, the conventional floating car system cannot utilize useful data (destination information and the like) of floating cars. Further, data of OD (origin-destination) employed in conventional traffic-volume prediction is based on past data, and its accuracy is low.

The present invention is accomplished in view of the above problems, and an object of the present invention is to provide a traffic congestion prediction method and a traffic congestion prediction device each of which is able to perform a prediction process using floating information with higher accuracy, that is, higher-accuracy traffic congestion prediction, POI customer-attraction prediction, traffic control, and the like, each of which is usable for a reservation service of local check-in, and each of which is able to predict an occurrence of an event by using the traffic congestion prediction method and the traffic congestion prediction device for an input of an event judgment apparatus as disclosed in Japanese Patent No. 4796167.

In order to achieve the above object, the present invention provides a traffic congestion prediction method for predicting traffic congestions by a traffic congestion prediction device based on information transmitted from a plurality of floating cars, including: a receiving step of receiving, by the traffic congestion prediction device, current position information and destination information transmitted from each of the plurality of floating cars; a route prediction step of predicting a route to a destination of the each of the plurality of floating cars based on the current position information and destination information received in the receiving step; a first calculation step of calculating, for the each of the plurality of floating cars, a first passing time group which is a set of respective passing times at a plurality of predetermined spots on the route thus predicted for the each of the plurality of floating cars in the route prediction step; an existing-number calculation step of calculating the number of existing floating cars per link based on the first passing time group calculated in the first calculation step if any of the plurality of floating cars exists on the link at a predetermined time, the link being a route between a predetermined two spots to be adjacent on the route thus predicted; and a second calculation step of calculating, for the each of the plurality of floating cars, a second passing time group which is a set of respective passing times at the plurality of predetermined spots by use of the number of existing floating cars calculated in the existing-number calculation step and a predetermined calculation technique. With this configuration, it is possible to perform a prediction process using floating information with higher accuracy, that is, higher-accuracy traffic congestion prediction, POI customer-attraction prediction, traffic control, and the like, the traffic congestion prediction method is usable for a reservation service of local check-in, and it is possible to predict an occurrence of an event by using the traffic congestion prediction method for an input of an event judgment apparatus as disclosed in Japanese Patent No. 4796167. Note that the destination information refers to information on a destination, which will be described later.

Further, it is a preferable aspect for the traffic congestion prediction method of the present invention to include the step of judging, for the each of the plurality of floating cars, whether or not a difference between a passing time of the predicted route based on the first passing time group and a passing time of the predicted route based on the second passing time group is a predetermined value or more, then, for each floating car of which the difference is the predetermined value or more, updating the first passing time group by the second passing time group and calculating the number of existing floating cars at the predetermined time per link, and calculating the second passing time group for the each floating car by use of the number of existing floating cars thus calculated and the given calculation technique. With this configuration, it is possible to perform prediction with higher accuracy.

Further, it is a preferable aspect for the traffic congestion prediction method of the present invention to calculate the first passing time group based on a distance between respective links and a speed of a floating car targeted for the calculation. With this configuration, it is possible to easily calculate a first passing time.

Furthermore, it is a preferable aspect for the traffic congestion prediction method of the present invention that the predetermined calculation technique used for calculating the second passing time group is a calculation technique using a QV curve. With this configuration, it is possible to calculate a highly accurate second passing time.

Further, the present invention provides a predicted traffic congestion prediction device for predicting traffic congestions based on information transmitted from a plurality of floating cars, including: receiving means for receiving current position information and destination information transmitted from each of the plurality of floating cars; prediction means for predicting a route to a destination of the each of the plurality of floating cars based on the current position information and destination information thus received; first calculation means for calculating, for the each of the plurality of floating cars, a first passing time group which is a set of respective passing times at a plurality of predetermined spots on the route thus predicted for the each of the plurality of floating cars; existing-number calculation means for calculating the number of existing floating cars per link based on the first passing time group thus calculated if any of the plurality of floating cars exists on the link at a predetermined time, the link being a route between a predetermined two spots to be adjacent on the route thus predicted; and second calculation means for calculating, for the each of the plurality of floating cars, a second passing time group which is a set of respective passing times at the plurality of predetermined spots by use of the number of existing floating cars thus calculated and a predetermined calculation technique. With this configuration, it is possible to perform a prediction process using floating information with higher accuracy, that is, higher-accuracy traffic congestion prediction, POI customer-attraction prediction, traffic control, and the like, the traffic congestion prediction device is usable for a reservation service of local check-in, and it is possible to predict an occurrence of an event by using the traffic congestion prediction device for an input of an event judgment apparatus as disclosed in Japanese Patent No. 4796167.

Further, it is a preferable aspect for the traffic congestion prediction device of the present invention to further include judgment means for judging, for the each of the plurality of floating cars, whether or not a difference between a passing time of the predicted route based on the first passing time group and a passing time of the predicted route based on the second passing time group is a predetermined value or more, wherein: for each floating car of which the difference is the predetermined value or more, the existing-number calculation means updates the first passing time group by the second passing time group and calculates the number of existing floating cars at the predetermined time per link; and the second calculation means calculates the second passing time group for the each floating car based on the number of existing floating cars thus calculated and the predetermined calculation technique. With this configuration, it is possible to perform prediction with higher accuracy.

Further, it is a preferable aspect for the traffic congestion prediction device of the present invention to calculate the first passing time group based on a distance between respective links and a speed of a floating car targeted for the calculation. With this configuration, it is possible to easily calculate a first passing time.

Furthermore, it is a preferable aspect for the traffic congestion prediction device of the present invention that the predetermined calculation technique used for calculating the second passing time group is a calculation technique using a QV curve. With this configuration, it is possible to calculate a highly accurate second passing time.

The traffic congestion prediction method and the traffic congestion prediction device according to the present invention have the above configuration, and are able to perform a prediction process using floating information with higher accuracy, that is, higher-accuracy traffic congestion prediction, POI customer-attraction prediction, traffic control, and the like, are usable for a reservation service of local check-in (preliminary congestion prediction, coupon distribution to reservation, various incentives, notification of meeting a friend, and the like), and able to predict an occurrence of an event by using the traffic congestion prediction method and the traffic congestion prediction device for an input of an event judgment apparatus as disclosed in Japanese Patent No. 4796167.

DESCRIPTION OF EMBODIMENTS

Figure 1:
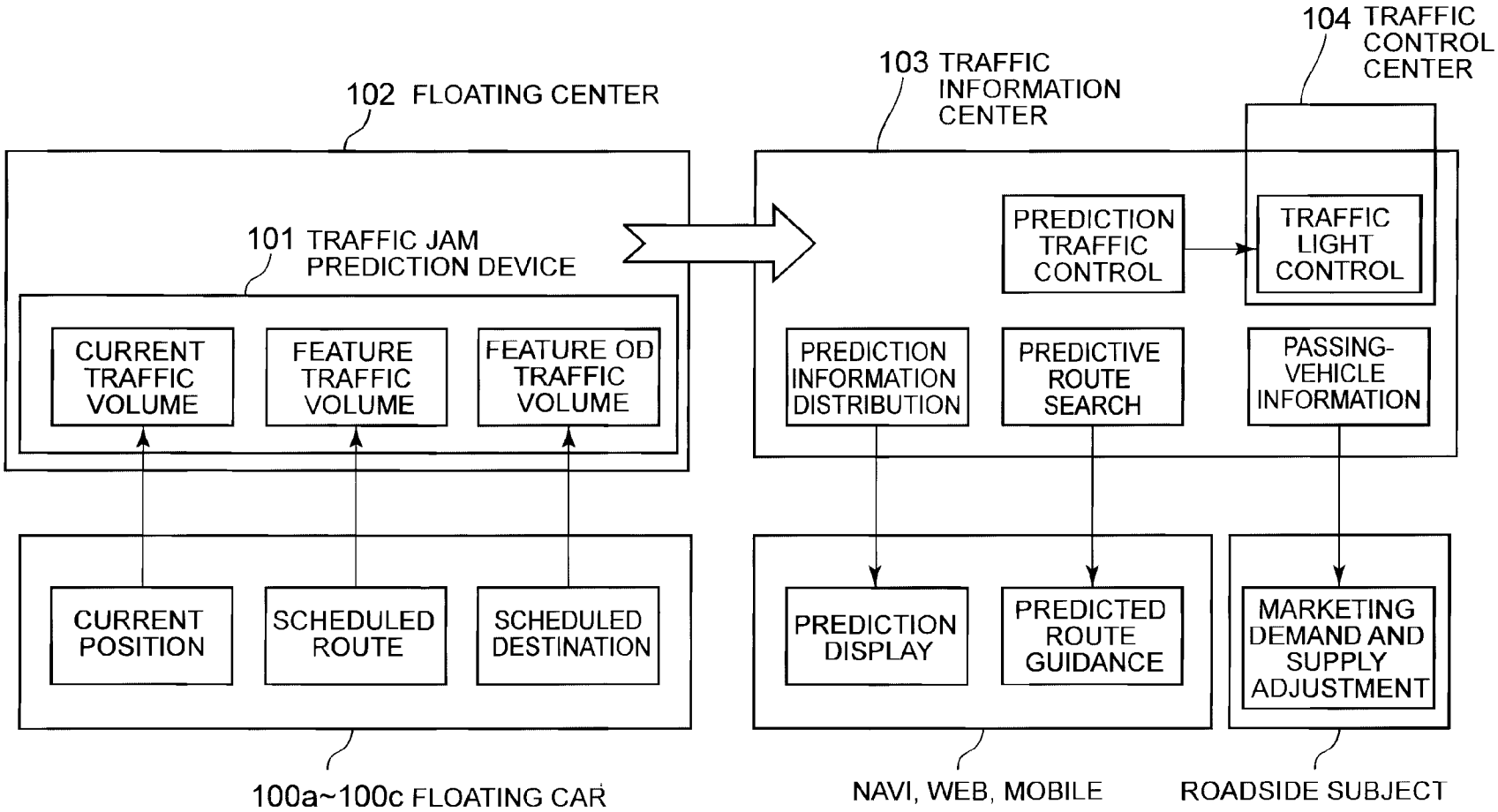
FIG. 1 is an example of a traffic congestion prediction system including a traffic congestion prediction device according to an embodiment of the present invention.

Initially, the following describes a traffic congestion prediction system including a traffic congestion prediction device according to an embodiment of the present invention, with reference to FIG. 1. As shown in FIG. 1, the traffic congestion prediction system is constituted by a plurality of floating cars 100*a* to 100*c* and a floating center 102 including a traffic congestion prediction device 101. Note that the number of floating cars is not limited to three. Initially, information on a current position, information of a scheduled route, and information on a scheduled destination are transmitted to the traffic congestion prediction device 101 of the floating center 102 from each of the plurality of floating cars 100*a* to 100*c*. Here, exemplary pieces of information transmitted from a floating car are the information of a current position, the information of a scheduled route, and the information of a scheduled destination, but only the information of a current position and the information of a scheduled destination may be transmitted. In this case, the traffic congestion prediction device 101 of the floating center 102 calculates a scheduled route for each of the floating cars.

When received pieces of information transmitted from the plurality of floating cars 100*a* to 100*c*, the traffic congestion prediction device 101 performs a process as described later and transmits a process result thereof to a traffic information center 103. The traffic information center 103 performs a prediction traffic control based on the process result thus received, performs, for example, a traffic light control by a traffic control center 104, performs distribution of predicted information (prediction information distribution) or guidance of a route search (predictive route search) to a navi (a navigation system), a Web, a mobile (a mobile terminal), and the like, and also provides information on vehicles passing by (passing-vehicle information) to a roadside subject. The provision to the roadside subject will be described later.

Figure 2:
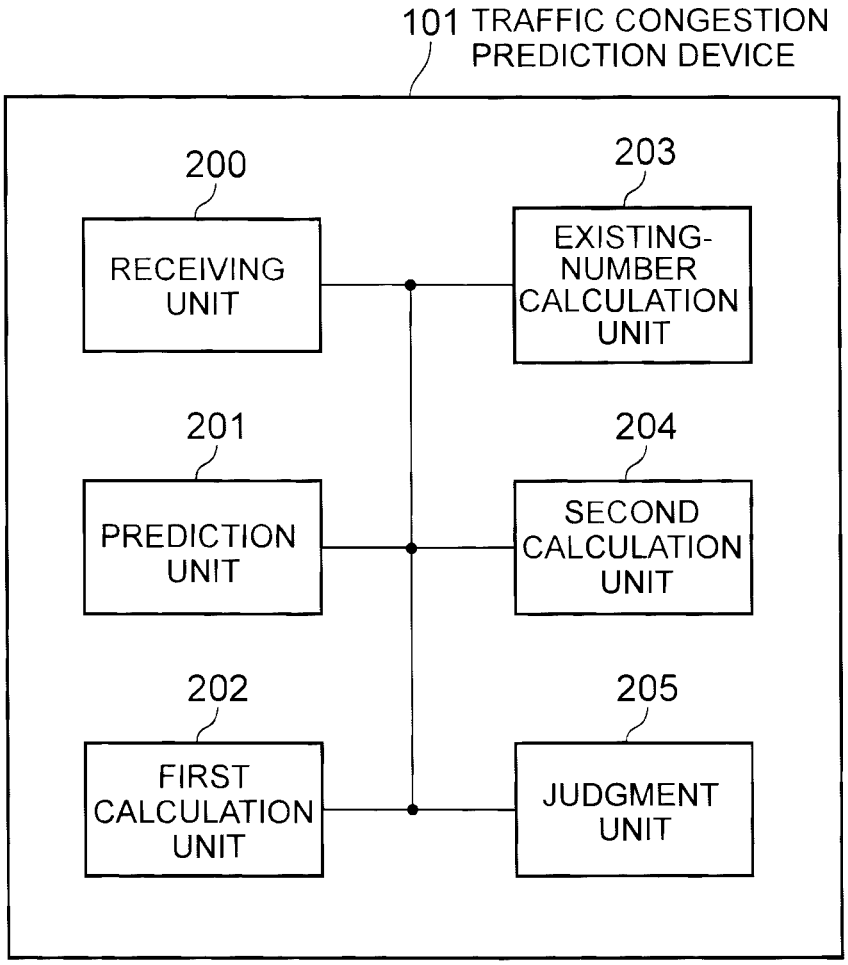
FIG. 2 is an example configuration diagram of the traffic congestion prediction device according to the embodiment of the present invention.

Here, the following describes the traffic prediction device according to the embodiment of the present invention with reference to FIG. 2. As shown in FIG. 2, the traffic congestion prediction device 101 is constituted by a receiving unit 200, a prediction unit 201, a first calculation unit 202, an existing-number calculation unit 203, a second calculation unit 204, and a judgment unit 205. The receiving unit 200 receives information on a current position and information on a scheduled destination from each of the plurality of floating cars 100*a* to 100*c*. Note that the following describes a case where information on a scheduled route is not transmitted from a floating car, but in a case where information on a scheduled route is transmitted from a floating car, a process by the prediction unit, which will be described later, becomes needless.

The prediction unit 201 predicts a route to a destination of each of the floating cars based on the received information on a current position and the received information of a scheduled destination. The prediction here is performed, for example, by a Dijkstra method, route prediction based on a past history, and the like. The first calculation unit 202 calculates first passing times, which are passing times at a plurality of predetermined spots on the predicted route, for the each of the floating cars. The first passing time may be calculated by use of a distance between predetermined spots or may be calculated based on a time required for pass obtained according to traffic congestion prediction (a predicted link traveling time at the time of pass according to traffic congestion prediction). Alternatively, a time found from experience may be used. Here, the predetermined spot refers to a spot determined on map information in advance, and indicates an intersection, a spot where a traffic light is provided, and the like, for example.

Figure 3:
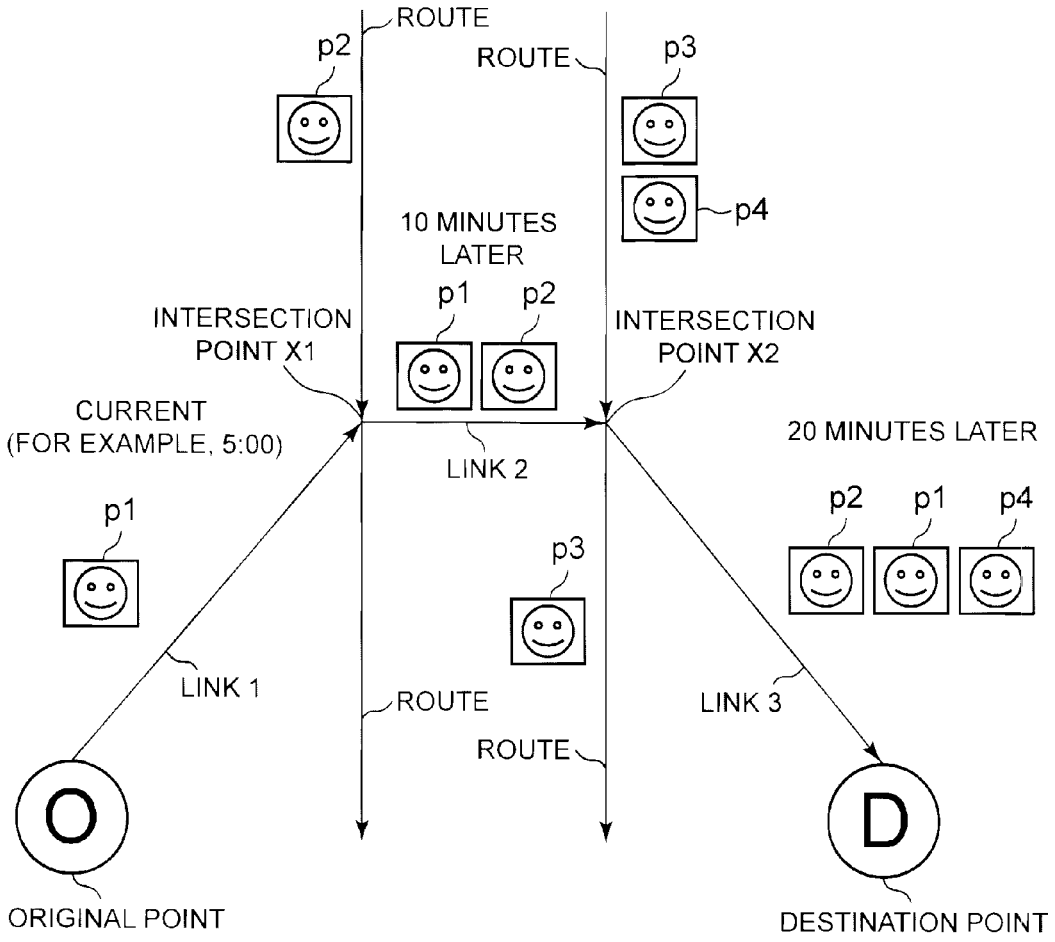
FIG. 3 is a figure to explain an example of calculation of a first passing time in the embodiment of the present invention.

Here, the calculation of the first passing time is described with reference to FIG. 3. As shown in FIG. 3, a route from a given original point O to a destination point D intersects with other routes at intersection spots X1 and X2. In this case, the first passing times are respective passing times at which each floating car passes through the intersection spots X1 and X2. Therefore, as for floating cars p1 and p2, passing times at which the floating cars p1 and p2 pass the intersection spots X1 and X2 are calculated, and as for floating cars p3 and p4, passing times at which the floating cars p3 and p4 pass the intersection spot X2 are calculated.

The existing-number calculation unit 203 calculates, per link which is a route between predetermined spots, the number of floating cars existing on the link at a predetermined time based on the first passing times thus calculated. Here, the predetermined time indicates a time which is determined in advance. With reference to FIG. 3, for example, respective times (the first passing times) at which the floating car p1 passes through the intersection spots X1 and X2 are assumed 5:05 and 5:15, respective times (the first passing times) at which the floating car p2 passes the intersection spots X1 and X2 are assumed 5:03 and 5:13, a time (the first passing time) at which the floating car p3 passes the intersection spot X2 is assumed 5:17, and a time (the first passing time) at which the floating car p4 passes the intersection spot X2 is assumed 5:16.

In this case, if the predetermined time is assumed 5:10 and 5:20, the numbers of floating cars existing between the original point O and the intersection spot X1 (on a link 1) at the respective times are 0 (as of 5:10) and 0 (as of 5:20), the numbers of floating cars existing between the intersection spot X1 and the intersection spot X2 (on a link 2) at the respective times are 2 (the floating cars p1 and p2 as of 5:10) and 0 (as of 5:20), and the numbers of floating cars existing between the intersection spot X2 and the destination point D (on a link 3) at the respective times are 0 (as of 5:10) and 3 (the floating cars p1, p2, and p4 as of 5:20). Note that links between predetermined spots encompass an area between the original point O and a first spot (the intersection spot X1) and an area between a final spot (the intersection spot X2) and the destination point D, as described above.

Figure 4:
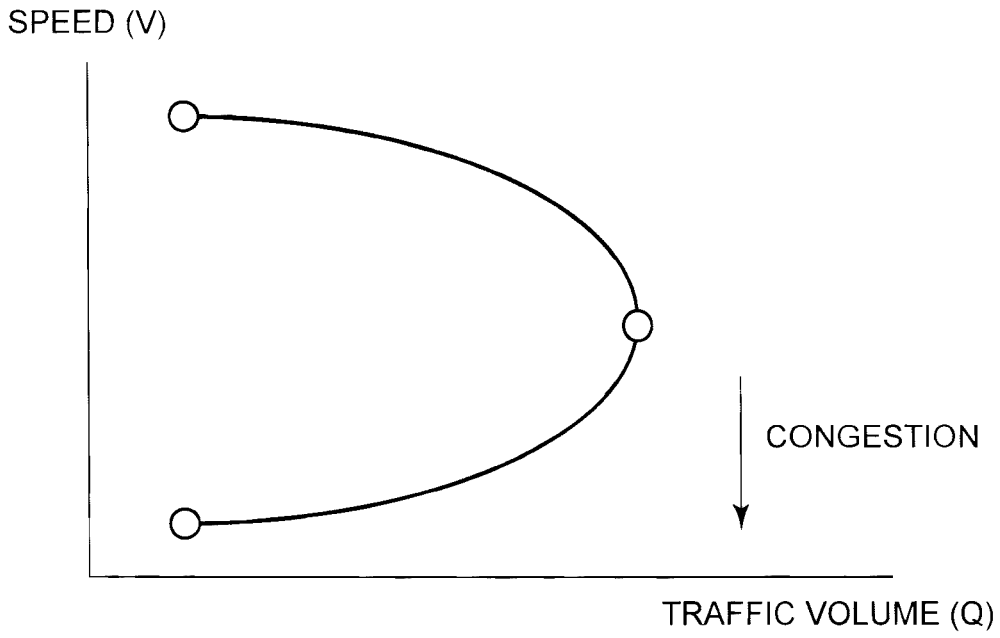
FIG. 4 is an example of QV curve used for calculating a second passing time in the embodiment of the present invention.

The second calculation unit 204 calculates second passing times, which are passing times at the plurality of predetermined spots, based on the calculated numbers of existing floating cars for each of the floating cars. For the calculation of this second passing time, a QV curve as shown in FIG. 4 may be used. As shown in FIG. 4, when there is a little traffic volume (Q), it is possible to travel at any desired speed or at a speed close to the desired speed, but as the traffic volume (Q) increases and a road becomes congested, the speed (V) decreases. That is, when a relationship between the traffic volume (Q) and the speed (V) is plotted with the traffic volume (Q) on the abscissa against the speed (V) on the ordinate, a curve (QV curve) in which the speed (V) decreases along with an increase of the traffic volume (Q) is obtained. If the number of existing floating cars is found, a speed of a floating car is found with the use of this curve, and if a distance from a current spot to a spot at an end of a current link is found, it is possible to calculate a passing time when the floating car passes through the spot at the end of the link.

The judgment unit 205 judges, per floating car, whether or not a difference between a passing time of the route based on the first passing times and a passing time of the route based on the second passing times is a predetermined value or more. For each floating car in which the difference is the predetermined value or more, the existing-number calculation 203 updates the first passing times by the second passing times and calculates the number of existing floating cars at the predetermined time per link, and then the second calculation unit 204 calculates second passing times based on the calculated number of existing floating cars for the each floating car.

For example, in regard to a given floating car, in a case where the passing time of the route based on the first passing times is 30 minutes and the passing time of the route based on the second passing times is 31 minutes, if the predetermined value is 3 minutes, the difference is 1 minute and thus less than the predetermined value, so that further calculation of the second passing times is not performed. On the other hand, if the difference is more than 3 minutes, further calculation of the second passing time is performed.

Figure 5:
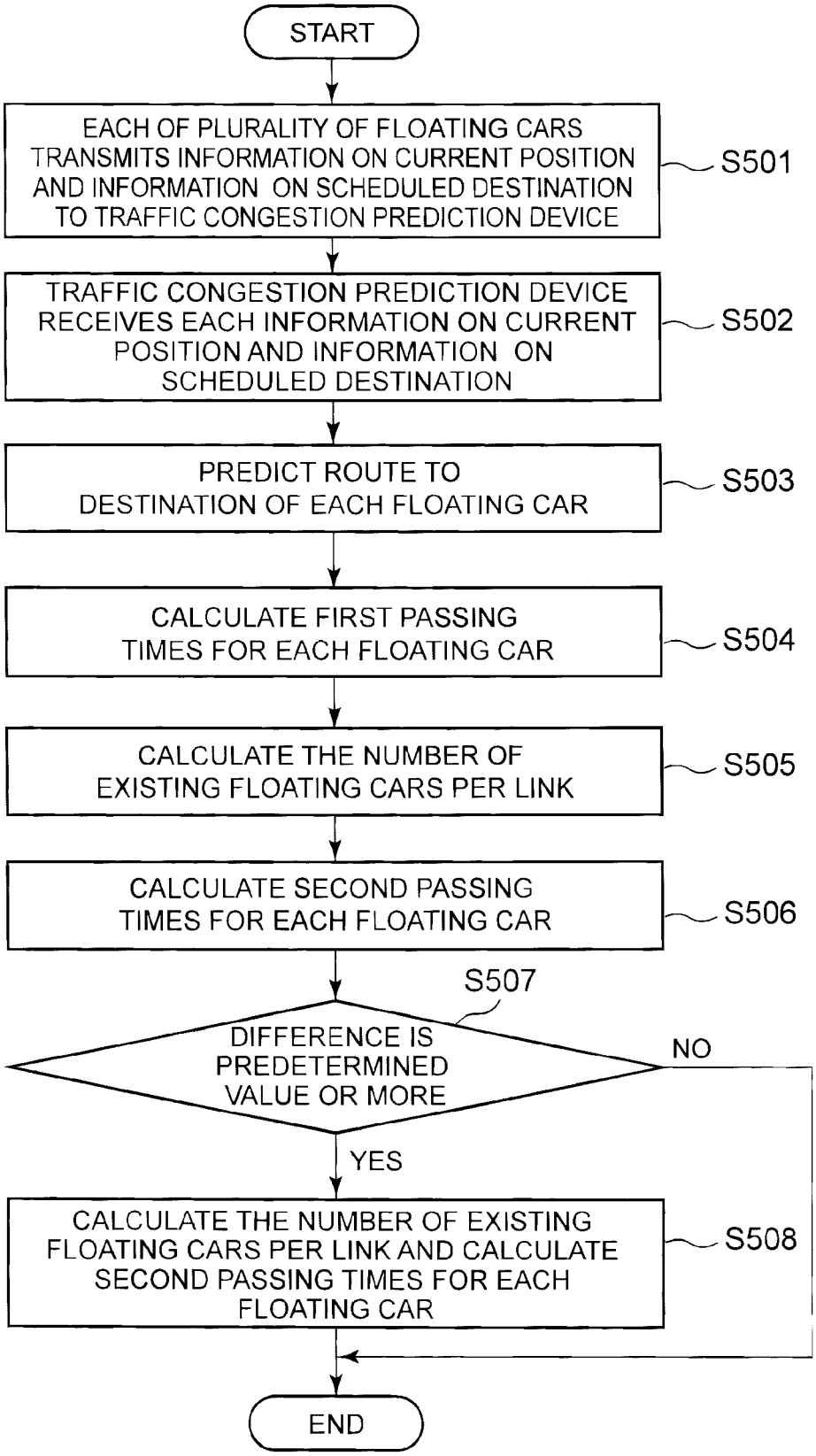
FIG. 5 is a flowchart to explain an example of a process flow of the traffic congestion prediction system including the traffic congestion prediction device according to the embodiment of the present invention.

Here, the following describes a process flow of the traffic congestion prediction system including the traffic congestion prediction device according to the embodiment of the present invention, with reference to FIG. 5. As shown in FIG. 5, each of the plurality of floating cars 100*a* to 100*c* transmits information on a current position and information on a scheduled destination (destination information) to the traffic congestion prediction device 101 (step S501). The traffic congestion prediction device 101 receives the information on a current position and the information on a scheduled destination from the each of the plurality of floating cars 100*a* to 100*c* (step S502). Note that the following deals with a case where information on a scheduled route is not transmitted from a floating car.

The traffic congestion prediction device 101 predicts a route to the destination of the each of the floating cars based on the received information on the current position and the received information of the scheduled destination (step S503). Then, the traffic congestion prediction device 101 calculates first passing times, which are passing times at a plurality of predetermined spots on the predicted route, for the each of the floating cars 100*a* to 100*c* (step S504). Subsequently, the traffic congestion prediction device 101 calculates, per link which is a route between predetermined spots, the number of floating cars existing on the link at a predetermined time based on the first passing times thus calculated (step S505).

Subsequently, the traffic congestion prediction device 101 calculates second passing times, which are passing times at the plurality of predetermined spots, based on the calculated number of existing floating cars for the each of the floating cars (step S506). For the calculation of this second passing time, a QV curve as shown in FIG. 4 may be used. Then, the traffic congestion prediction device 101 judges, for the each of the floating cars, whether or not a difference between a passing time of the route based on the first passing times and a passing time of the route based on the second passing times is a predetermined value or more (step S507). For each floating car in which the difference is the predetermined value or more, the traffic congestion prediction device 101 updates the first passing times by the second passing times and calculates the number of existing floating cars at the predetermined time per link, and calculates second passing times based on the calculated number of existing floating cars for the each of the floating cars (step S508).

Note that as for the scheduled destination and the scheduled route, routing by a car navigation system or a smartphone, or prediction results of a destination and a route estimation according to the following publications (Japanese Patent Application Laid-Open No. 2007-256075, Japanese Patent Application Laid-Open No. 2007-10572, and Japanese Patent Application Laid-Open No. 2008-157891) may be used.

Note that according to the above description, it is possible to figure out the number of existing floating cars on each link at a given time, and therefore, by providing these pieces of information to not only floating providers but also a subject (the aforementioned roadside subject) around a road which a floating car is going to pass through, it is possible to yield such an advantageous effect that the following new service can be provided.

For example, it is possible to provide a service according to a type (attribute or the like) of a user to pass by. More specifically, if it is found out in a gas station that "many tracks pass by" the gas station, then the gas station is able to prepare gas-oil generously. Further, if it is found in a family-style restaurant that "many family groups come," then the family-style restaurant is able to prepare menus for families generously or practice a campaign for children.

Furthermore, it is also possible to provide a service according to a destination of a user to pass by, for example. More specifically, if it is found in a convenience store that "there are many customers to go to ski," the convenience store is able to prepare ski-related goods. Further, if it is found in a supermarket that "there are many customers to go to a stadium," then the supermarket is able to prepare support goods or practice a support campaign.

Further, if floating providers register locations decided to go in advance, it is possible to know what kind of people (friends or other than friends) are going to go their destinations.

Further, it is also conceivable to apply the present invention to traffic volume prediction based on distribution from an OD traffic volume used in a general traffic simulation. Conventional OD data is past data, and since a traffic volume has been predicted based on the data, its accuracy has been low. Data used for this traffic volume prediction is an OD table, but the OD table refers to data which expresses a traffic moving amount between zones in a table (matrix) form. The conventional OD table is shown in the following website:

http://www.trpt.cst.nihon-u.ac.jp/TRSYSTEM/class/class_detail/t_s_plan/tra_a.pdf The following describes an application to the traffic volume prediction based on distribution from an OD traffic volume. Initially, in a case where an initial value or sufficient floating data is not obtained, an OD table of conventional past data is used. In a case where it is possible to obtain future OD by sufficient "prediction floating," data of the prediction floating is used for a corresponding OD. Further, in a case where a route is given in "prediction floating," its distribution is also used for route distribution.

INDUSTRIAL APPLICABILITY

A traffic congestion prediction method and a traffic congestion prediction device according to the present invention are able to perform a prediction process using floating information with higher accuracy, that is, higher-accuracy traffic congestion prediction, POI customer-attraction prediction, traffic control, and the like, are usable for a reservation service of local check-in, and are able to predict an occurrence of an event by using the traffic congestion prediction method and the traffic congestion prediction device for an input of an event judgment apparatus as disclosed in Japanese Patent No. 4796167. In view of this, the traffic congestion prediction method and the traffic congestion prediction device according to the present invention are useful as a traffic congestion prediction method and a traffic congestion prediction device for performing traffic congestion prediction based on information from floating cars.

What is claimed is:

1. A predicted traffic congestion prediction device for predicting traffic congestions based on information transmitted from a plurality of cars traveling on roads, comprising:

receiving means for receiving current position information and destination information transmitted from each of the plurality of cars;

prediction means for predicting a route to a destination of each of the plurality of cars based on the current position information and destination information thus received;

first calculation means for calculating, for each of the plurality of cars, a first passing time group which is a set of respective passing times at a plurality of predetermined spots on the route thus predicted for each of the plurality of cars;

existing-number calculation means for calculating the number of existing cars per a link of a plurality of links based on the first passing time group calculated by the first calculation means, if any of the plurality of cars exists on each of the plurality of links at a predetermined time, each of the plurality of links being a route between two adjacent spots among a plurality of predetermined spots on the route thus predicted; and second calculation means for calculating, for each of the plurality of cars, a second passing time group which is a set of respective passing times at the plurality of predetermined spots used by the number of existing cars calculated by the existing-number calculation means; and judgment means for judging, for each of the plurality of cars, whether or not a difference between a passing time of the predicted route based on the first passing time group and a passing time of the predicted route based on the second passing time group is equal to or greater than a predetermined value;

wherein the existing-number calculation means updates the first passing time group by the second passing time group for the each car of which the difference is judged to be equal to or greater than the predetermined value and calculates the number of existing cars per the link at the predetermined time based on the first passing time group thus updated; and wherein the second calculation means calculates the second passing time group for the each car of which the difference is judged to be equal to or greater than the predetermined value based on the number of existing cars thus calculated.

2. The traffic congestion prediction device according to claim 1, wherein the first passing time group is calculated based on a length of each of said links and a speed of a car targeted for the calculation.

3. The traffic congestion prediction device according to claim 1, wherein a speed of each of plurality of cars is obtained from the number of existing cars by referring to a predetermined relationship between traffic volume and the speed of the each car when calculating the second passing time group.

* * * * *